United States Patent [19]

Standiford

[11] 4,274,169

[45] Jun. 23, 1981

[54] BED COVERING HAVING TUCKABLE PORTION

[76] Inventor: Natalie C. Standiford, 1 Englewood Rd., Baltimore, Md. 21210

[21] Appl. No.: 35,545

[22] Filed: May 3, 1979

[51] Int. Cl.[3] ..... A47G 9/02

[52] U.S. Cl. ..... 5/502; 5/485

[58] Field of Search ..... 5/495, 496, 498, 499, 5/500, 501, 502, 482, 485, 486; D6/258, 260, 259

[56] References Cited

U.S. PATENT DOCUMENTS

| | | | |
|---|---|---|---|
| 1,867,425 | 7/1932 | Swetzel | 5/449 |
| 2,263,810 | 11/1941 | Leslie et al. | 5/502 |
| 3,027,573 | 4/1962 | Bell | 5/470 |
| 3,467,974 | 9/1969 | Devtsch | 5/496 |
| 3,621,498 | 11/1971 | Cooper | 4/498 |
| 4,014,055 | 3/1977 | Torres | 5/485 |

FOREIGN PATENT DOCUMENTS

| | | | |
|---|---|---|---|
| 564949 | 7/1957 | Italy | 5/485 |
| 811768 | 4/1959 | United Kingdom | D6/258 |
| 927094 | 5/1963 | United Kingdom | 5/485 |

*Primary Examiner*—Alexander Grosz

[57] ABSTRACT

A bed covering, which functions as a spread, comforter and top sheet, is formed by joining two identically dimensioned layers of fabric which are stitched together along three edges with a foot edge of the layers remaining unstitched. Each layer is generally the size of a spread which fits a particular size bed such as, for example, a single or double size bed. Side and foot edge portions of the layers extend to the floor from the top of the bed to provide a spread effect. Pockets are formed between a central portion of the two layers and are stuffed with a heat-insulating material such as, for example, down or polyester fibers.

When the bed covering is placed on a bed, the unstitched edge portion of the bottom layer adjacent to the foot edge is tucked between the mattress and box springs of the bed to secure the bed covering with the bed. Since the tuckable portion is not stuffed, it does not lift the foot of the mattress and holds the bed covering securely.

The bed covering can provide an identical physical appearance from either side thereof and can, therefore, be reversible. Consequently, either side of the bed covering can function as the exterior surface or layer of the covering. This permits a choice of different fabrics and designs for the two layers while functioning as a single bed covering.

6 Claims, 2 Drawing Figures

BED COVERING HAVING TUCKABLE PORTION

BACKGROUND OF THE INVENTION

This invention relates to bed coverings and particularly to a bed covering having a tuckable portion to facilitate retention of the covering with the bed.

In some instances, bed clothing such as spreads are placed over the mattress of a bed to serve as a decorative covering when the bed is not in use. Such spreads are generally formed from a single fabric layer, are flat and drape over the bed with edge portions depending to the floor to conceal the mattress, box springs and the open-space underportions of the bed. Frequently, a spread is also used as a heat-retention facility by a bed user. However, due to the typical thinness, and the texture, of the single layered fabric, the spread is usually supplemented with a top sheet and, at times, a blanket. Spreads which are draped over the bed and not otherwise secured thereto are usually retainable with the bed as a decorative bed covering but occasionally do slip from the bed when in use as a heat-retention facility.

Comforters are used, at times, as a decorative covering and are also used as a heat-retention facility by a user of the bed. Comforters are generally formed by two layers of material which are woven together along all edges and are formed in decorative patterns with quilted pockets therebetween. The pockets can be filled with a fiber material or down and provide a bulky appearance.

Comforters do not extend to the floor when draped over a bed. The opening between the box springs and the floor is then exposed and can be covered by a decorative dust ruffle which is independent of the comforter. One example of a dust ruffle is the type which is draped over the box springs and provides a ruffle extending from the top edges of the box springs to the floor. When a comforter is draped over the mattress, the separate dust ruffle complements the comforter for a decorative bed covering effect.

Due to the typical bulkiness of comforters, they cannot be tucked easily between portions of the bed for securance purposes and, therefore, they have a tendency to shift on the bed and frequently fall onto the floor. This is particularly a problem when the comforter is used as a heat-retention facility by a user of the bed.

As disclosed in U.S. Pat. No. 4,014,055, a sheet-spread includes a body portion which fits generally atop a bed and further includes a depending circumferential section which is dimensioned and configured to be inserted beneath the mattress or box springs for retaining the sheet-spread with the bed. The depending circumferential section appears to resemble the edges of a conventional fitted bottom sheet which has some elasticity for fitting the edges of the sheet beneath the mattress or box springs. The circumferential section extends around all edges of the sheet-spread to facilitate securing of all edges thereof with the bed. A flounce is attached circumferentially to the body portion and extends to the floor.

In use, the sheet-spread is literally used as a fitted bottom sheet when someone is using the bed. This requires that top bed coverings, such as a top sheet and blanket, be used as heat-retention facilities. However, it would appear that the presence of the flounce prevents the convenient and ready securing of the top bed coverings with the bed. Additionally, it would appear that when the sheet-spread is used as a bottom sheet, the body portion thereof would become wrinkled. When the same sheet-spread is then used as a spread, it would reveal a wrinkled appearance.

Great Britain Pat. No. 811,768 shows a combination covering including an outer cover which is of sufficient dimension to drape over the bed toward the floor at the sides and foot thereof. The outer covering is of a decorative nature and may be plain or quilted in the central portion. A blanket is detachably fastened to the underside or inner face of the cover. Two longitudinal tapes are secured by permanent stitching in a parallel arrangement to spaced portions of the underside of the cover. Spaced holes are formed in each tape and provide facility for routing a thread through the holes and the blanket to detachably fasten the blanket with the cover. When it is desired to separate the blanket and cover, the thread is removed. The blanket is sufficiently wide to permit portions thereof to be tucked between the mattress and box springs to retain the combined cover and blanket with the bed.

A sheet is detachably fastened to the exposed side of the blanket by facility of button holes in the sheet and buttons on the blanket.

The combination covering disclosed in the Great Britain patent requires that several independent elements be joined together to accomplish the desired effect. A blanket is required for the securing of the covering to the bed and is required with a sheet to provide for the heat-retention facility. The manner of assembly of the different elements of the covering is complicated and time consuming.

Thus, there is a need for a bed covering, such as a spread or comforter, which can be easily secured to and conveniently retained atop a bed particularly when the covering is used as a heat-retention facility by a bed user.

Further, there is a need for a simple bed covering which can provide the facilities of a top sheet, a decorative spread and a warming comforter which can be easily secured to and retained atop a bed at all times.

Still further, there is a need for a bed covering which is reversible and can thereby be used from either side as the exterior surface.

SUMMARY OF THE INVENTION

A bed covering embodying certain principles of the invention includes a first layer of fabric material which is secured to a second layer of fabric along three adjacent edges thereof with one edge remaining unstitched.

The bed covering can be placed over a bed so that side and foot edge portions of the covering drape to the floor along the sides and at the foot of the bed with the unstitched edge located at the foot of the bed. The foot-edge portion of the bottom layer of the bed covering can be tucked between the mattress and box springs of the bed to secure the covering with the bed. The outer layer of the foot-edge portion provides an exterior appearance which conceals the tucked portion and which drapes toward the floor.

In another feature of the bed covering embodying further principles of the invention, a central portion of the bed covering between the two layers is formed with a plurality of pockets which are filled with a heat-insulating material such as down or polyester fibers. This provides a comforter effect.

Other features of the bed covering embodying still further principles of the invention include the layers being made of different or the same material and of the same or different patterns.

DETAILED DESCRIPTION

Figure 1:
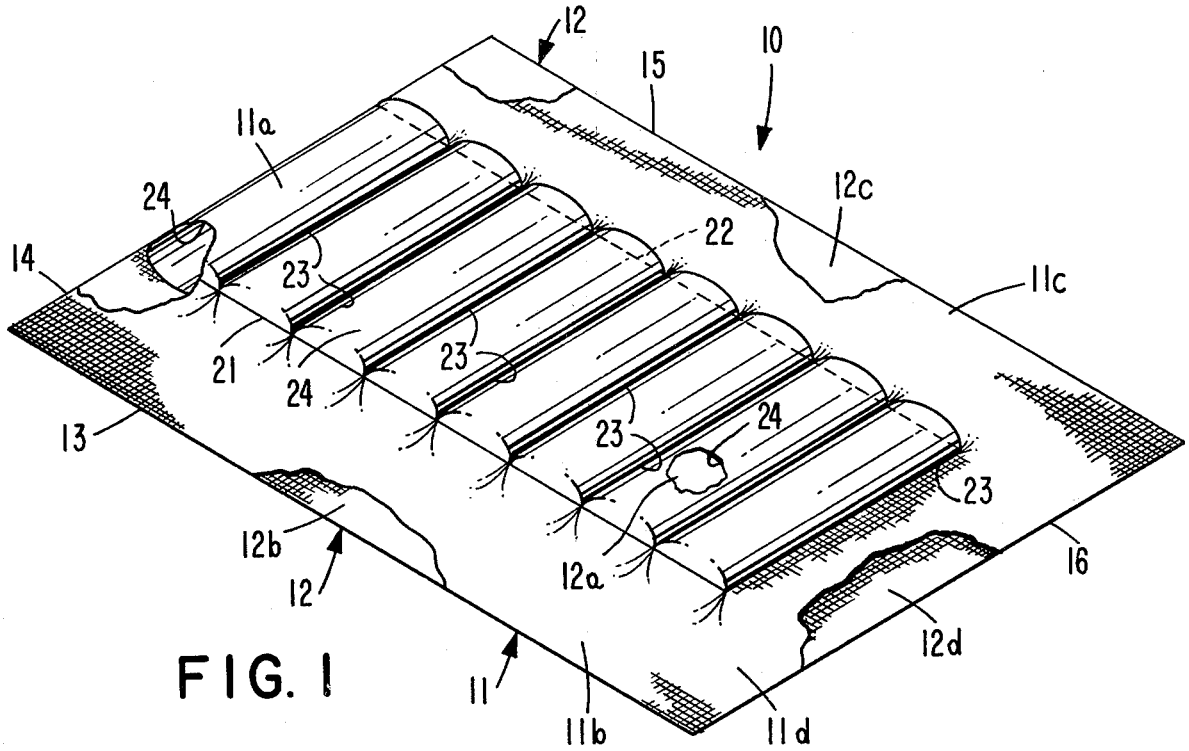
FIG. 1 is a perspective view with parts broken away showing a bed covering embodying certain principles of the invention.

Referring to FIG. 1, a bed covering, designated generally by the numeral 10, includes a first layer of a fabric material and a second layer 12 of a fabric material. Each of the layers 11 and 12 are the size of a conventional spread which is positionable over a bed of conventional size such as a single or double size bed. Initially, in the manufacture of the covering 10, the two layers 11 and 12 are placed together and stitched along three edges 13, 14 and 15. Edge 16 of the two layers 11 and 12 remains unstitched. The joined layers 11 and 12 are then turned inside out by facility of the unstitched edge 16 so that the stitching along edges 13, 14 and 15 are now concealed within the joined layers and thereby provide a finished effect. The layer 11 is formed with a central portion 11*a*, side-edge portions 11*b* and 11*c* and a foot-edge portion 11*d*. The layer 12 is formed with a central portion 12*a*, side-edge portions 12*b* and 12*c* and a foot edge portion 12*d*. Each of the layers 11 and 12 is formed with a head portion adjacent to the stitched edge 14.

Figure 2:
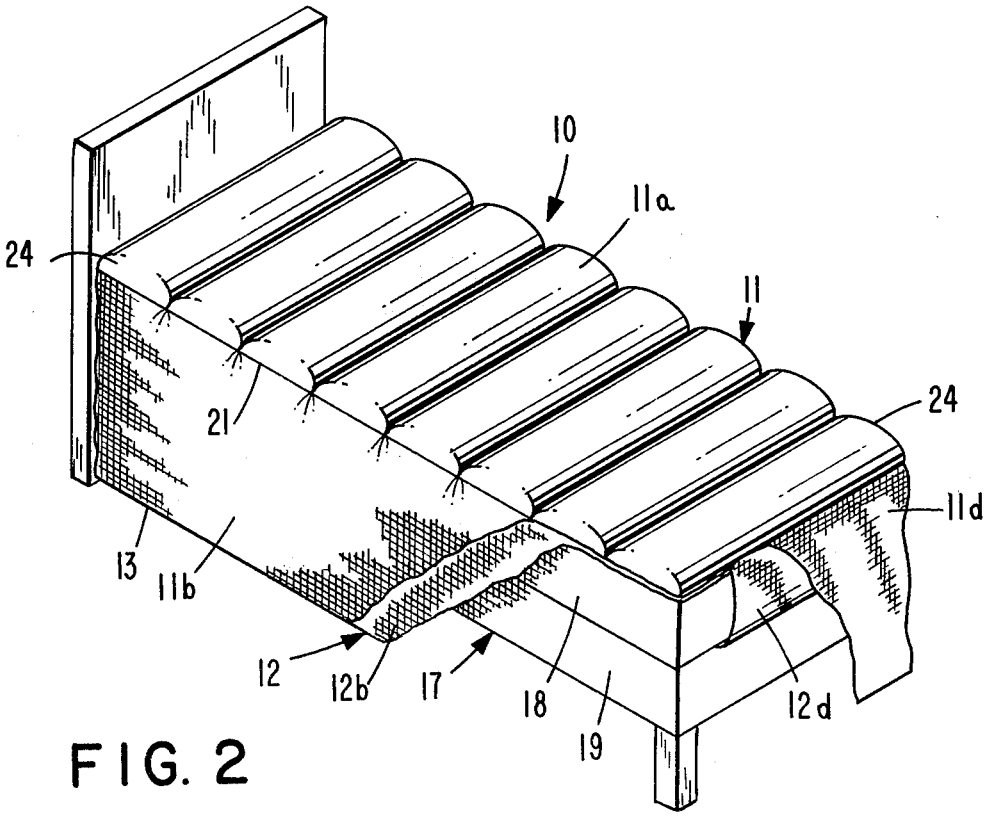
FIG. 2 is a perspective view showing the bed covering of FIG. 1 positioned on a bed.

As illustrated in FIG. 2, a bed 17 includes a mattress 18 and box springs 19 supported on a frame. When the bed covering 10 is placed on top of the bed 17, the central portions 11*a* and 12*a* rest on top of the bed. The side-edge portions 11*b*, 11*c*, 12*b* and 12*c* and the foot-edge portions 11*d* and 12*d* extend over the edge of the bed toward the floor to provide a spread effect and to conceal the sides of the mattress 18 and box springs 19 as well as the open space between the box springs and the floor. After the bed covering 10 has been placed atop the bed 17, the foot edge portions 11*d* and 12*d* are raised to expose the foot edge portion 12*d*. The foot edge portion 12*d* is then placed or tucked between the mattress 18 and box springs 19, as illustrated in FIG. 2, to secure the bed covering 10 with the bed 17. The foot edge portion 11*d* is again placed over the foot of the bed 17 to conceal the tucked foot edge portion 12*d* as well as the mattress 18, box springs 19 and the space between the box springs and the floor. This provides a complete spread effect while facilitating securance of the bed covering 10 with the bed 17. In this arrangement of the bed covering 10 atop the bed 17, the layer 12 functions as a top sheet while the layer 11 serves as an outer spread. When the layers 11 and 12 are of the same fabric, the bed covering 10 can be placed atop the bed 17 with either layer serving as the outer spread. Thus, in this arrangement, the bed covering 10 is reversible. When the layer 12 functions as the spread, layer 11 functions as the top sheet and the foot-edge portion 11*d* is tucked between the mattress 18 and box springs 19 to secure the bed covering 10 with the bed 17. The fabric of each of the layers 11 and 12 can be woven with the same design, pattern or can be the same solid color, or can be of contrasting colors without any design or pattern.

In other embodiments, the layers 11 and 12 of the bed covering 10 could be made of different fabrics. For example, layer 12, which serves as the top sheet in the illustration of FIG. 2, can be made from a cotton or cotton blend fabric or of any material typically used for a top sheet. Layer 11, which functions as the spread, can be a decorative material such as satin, rayon, polyester, cotton or many different blends or combinations of materials typically used for spreads or comforters.

The fabric used for the layers 11 and 12 can also be of contrasting colors or could be of different decorative patterns. Also, the layers 11 and 12 can be formed from different materials containing the same or different decorative patterns.

As further illustrated in FIG. 1, the central portions 11*a* and 12*a* are united and sewn together along stitch lines 21 and 22 and along pocket stitch lines 23 to form a plurality of pockets 24. The pockets 24 are filled with a suitable heat-insulating material such as polyester fibers. The pockets 24 can be formed in any desired pattern to provide a decorative or quilted appearance and to retain the heat-insulating material.

In another aspect of the preferred embodiment, the bed covering 10 is provided with the fiber-filled pockets 24 which provide a heat-retention facility for a bed user in the same manner as the heat-retention properties of a comforter. Since the pockets 24 are formed in both layers 11 and 12, the bed covering 10 retains its reversible utility of providing a decorative or quilted effect regardless of whether the layer 11 or layer 12 is used as the outer spread.

Thus, as illustrated in FIG. 2, the bed covering 10 functions as a decorative bed spread which is secured with the bed 17 when not in use by a bed user. Further, when the bed 17 is being used by a bed user, the layer 12 functions as a top sheet and the heat-insulating fibers within the pockets 24 function to retain body warmth generated by the bed user and thereby serves as a comforter. Also, the bed covering 10 continues to be secured with the bed 17 during use by the bed user.

Thus, the bed covering 10 provides a single facility which is securable with the bed 17 and provides a top sheet effect and heat-retention comforter effect for a bed user while providing a decorative spread when the bed is not being used. By virtue of the tuckable foot edge portions 11*d* or 12*d*, the bed covering remains secured with the bed 17 at all times whether the bed is being used or not being used. Further, since the bed covering 10 is made to present a similar physical appearance when either layer 11 or layer 12 serves as the spread, the bed covering is reversible. With the reversible feature, the layers 11 and 12 of the bed covering 10 can be made from the same or different fabrics, having the same or different patterns, or of the same or different color schemes. The reversible feature thus provides for versatility in use of the bed covering 10.

In another embodiment, the bed covering 10 could be assembled without having pockets 24 and filler material in an end portion of the central portions 11*a* and 12*a* adjacent to the stitch line 14. In this embodiment, the sections of the central portions 11*a* and 12*a* which form the pocketless end portion are placed in direct interfacing relation. This pocketless end portion of the bed covering 10 would normally rest at the head of the bed 17 (FIG. 2) and would provide for the positioning of a pillow (not shown) beneath the pocketless portion of the bed covering. This provides for a continued decorative bed covering effect while retaining pillows with the bed 17 when the bed is not in use.

The different embodiments of the bed covering 10 with its multiple functions saves time and material in making, laundering and decorating the bed 17 which would make the bed covering ideal for home as well as commercial use, for example, in hotels, motels and the like.

What is claimed is:

1. A reversible bed covering, which comprises:

a first layer of fabric material having a head portion, two side edges and a foot edge extending completely between the side edges;

a second layer of fabric having a head portion, two side edges and a foot edge extending completely between the side edges;

the first and second layers being of the same size and placed in interfacing relation;

the head portion and the side edges of the first layer being secured, respectively, to the head portion and the side edges of the second layer;

the foot edges of the first and second layers being unsecured between the side edges of the first and second layers;

each of the first and second layers of fabric material being formed with a central portion which normally rests atop a bed;

the central portions of the first and second layers being in interfacing relation;

a plurality of pockets formed in the first and second layers, in the area of the central portions;

and heat-insulating material located within the plurality of pockets.

2. The bed covering as set forth in claim 1 which further comprises a pocketless end portion formed by directly interfacing sections of the central portions which sections normally rest at the top of the head of the bed.

3. The bed covering as set forth in claim 1, wherein the side edges and foot edge of the first and second layers are of sufficient dimension so that, when the bed covering is placed atop the bed, the side edges and foot edge extend toward a floor on which the bed is supported.

4. The bed covering as set forth in claim 1 wherein the first and second layers of fabric material are composed of the same material.

5. The bed covering as set forth in claim 1 wherein the first and second layers of fabric material are composed of different materials.

6. The bed covering as set forth in claim 1 wherein the heat-insulating material includes polyester fibers.

* * * * *